US008899322B2

(12) United States Patent
Cresswell et al.

(10) Patent No.: US 8,899,322 B2
(45) Date of Patent: Dec. 2, 2014

(54) AUTONOMOUS DOWNHOLE CONTROL METHODS AND DEVICES

(75) Inventors: Gary J. Cresswell, Houston, TX (US); William Befeld, Richmond, TX (US); Robert Estes, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 362 days.

(21) Appl. No.: 12/049,714

(22) Filed: Mar. 17, 2008

(65) Prior Publication Data

US 2008/0257546 A1 Oct. 23, 2008

Related U.S. Application Data

(63) Continuation-in-part of application No. 11/858,077, filed on Sep. 19, 2007, now Pat. No. 8,122,954.

(60) Provisional application No. 60/845,912, filed on Sep. 20, 2006.

(51) Int. Cl.
*E21B 47/09* (2012.01)
*E21B 47/04* (2012.01)

(52) U.S. Cl.
CPC ..... *E21B 47/04* (2013.01)
USPC ..... 166/255.1; 166/66; 73/152.02

(58) Field of Classification Search
USPC ..... 166/255.1, 64, 66; 73/152.01, 152.02, 73/152.54
See application file for complete search history.

(56) References Cited

U.S. PATENT DOCUMENTS 2,221,767 A 11/1940 Hayward et al.
3,504,370 A 3/1970 Rebilly
4,041,780 A 8/1977 Angehrn
4,734,860 A 3/1988 Egli et al.
4,739,325 A 4/1988 MacLeod
4,976,143 A 12/1990 Casso
5,019,978 A 5/1991 Howard, Jr. et al.
5,058,077 A 10/1991 Twist (Continued)

FOREIGN PATENT DOCUMENTS

EP 0361996 4/1990
EP 2063069 A1 5/2009
GB 2330598 A 4/1999
WO WO02103158 12/2002

OTHER PUBLICATIONS

UK Application No: GB1015697.4; Search and Examination Report, May 25, 2012.

*Primary Examiner* — Robert E Fuller
(74) *Attorney, Agent, or Firm* — Mossman Kumar & Tyler PC

(57) ABSTRACT

Autonomous control of a wellbore tool is provided by programming a memory module of a processor with a database having data relating to a selected parameter of interest; conveying a sensor and the processor along the wellbore; and activating the wellbore tool if the processor determines that a measurement provided by the sensor correlates with the database data. The processor may correlate the sensor measurements with a predetermined pattern associated with the data, a preset value, and/or a preset range of values. Well tool activation may occur when the processor finds: a substantial match between a predetermined pattern and at least one measured value; a present value and at least one measured value, and/or a preset range of values and at least one measured range of values. Also, activating the well tool may occur only if a measurement from a second sensor meets a preset criteria.

23 Claims, 3 Drawing Sheets

(56) References Cited

U.S. PATENT DOCUMENTS

| | | | | |
|---|---|---|---|---|
| 5,230,387 | A | 7/1993 | Waters et al. | |
| 5,274,552 | A | 12/1993 | Milburn | |
| 5,341,886 | A | 8/1994 | Patton | |
| 5,439,064 | A | 8/1995 | Patton | |
| 5,581,024 | A | 12/1996 | Meyer, Jr. et al. | |
| 5,732,776 | A | 3/1998 | Tubel et al. | |
| 5,812,068 | A | 9/1998 | Wisler et al. | |
| 5,813,480 | A | 9/1998 | Zaleski, Jr. et al. | |
| 5,896,939 | A | 4/1999 | Witte | |
| 6,046,685 | A * | 4/2000 | Tubel | 340/853.2 |
| 6,109,370 | A * | 8/2000 | Gray | 175/61 |
| 6,173,793 | B1 * | 1/2001 | Thompson et al. | 175/45 |
| 6,233,524 | B1 | 5/2001 | Harrell et al. | |
| 6,516,898 | B1 | 2/2003 | Krueger | |
| 6,618,675 | B2 | 9/2003 | Strickland | |
| 6,736,221 | B2 | 5/2004 | Chia et al. | |
| 6,769,497 | B2 * | 8/2004 | Dubinsky et al. | 175/27 |
| 6,896,056 | B2 * | 5/2005 | Mendez et al. | 166/254.2 |
| 7,181,960 | B2 | 2/2007 | Sheng et al. | |
| 7,254,486 | B2 | 8/2007 | Guo | |
| 7,283,061 | B1 * | 10/2007 | Snider et al. | 340/854.8 |
| 2005/0060096 | A1 | 3/2005 | Hutchinson | |
| 2005/0160812 | A1 | 7/2005 | Ekseth et al. | |
| 2005/0269106 | A1 | 12/2005 | Wilson et al. | |
| 2008/0257546 | A1 | 10/2008 | Cresswell et al. | |
| 2009/0173538 | A1 | 7/2009 | Estes et al. | |

* cited by examiner

AUTONOMOUS DOWNHOLE CONTROL METHODS AND DEVICES

CROSS-REFERENCE

This application is a continuation-in-part of U.S. patent application Ser. No. 11/858,077 filed Sep. 19, 2007, which claims priority from U.S. Provisional Application Ser. No. 60/845,912 filed on Sep. 20, 2006.

FIELD OF THE DISCLOSURE

1. Field of the Disclosure

The disclosure relates to a method and an apparatus for the autonomous control of downhole tools.

2. Background of the Disclosure

Hydrocarbons are recovered from underground reservoirs using wellbores drilled into the formation bearing the hydrocarbons. The construction and subsequent use of a well for recovering hydrocarbons typically involves the deployment of a variety of tools into a wellbore. Conventionally, the effective operation of these tools while in the wellbore may require some form of control. Certain conveyances such as wirelines can provide a relatively fast rate of data transfer between the surface and a downhole tool. Thus, such devices may be operated from the surface. However, downhole tools used in connection with conveyance devices such as drill pipe, coiled tubing, slick-lines and drop tools may have inadequate access to communication uplinks and downlinks. Thus, surface personnel may have limited operational control over such tools.

The present disclosure addresses the need to provide control for tools deployed in a downhole environment.

SUMMARY OF THE DISCLOSURE

In aspects, the present disclosure provides a method for autonomously controlling wellbore tools. An illustrative method may include programming a memory module of a processor with a database having data relating to a selected parameter of interest; conveying a sensor and the processor along the wellbore; and activating a wellbore tool positioned in the wellbore if the processor determines that a measurement provided by the sensor correlates with the data in the database. In aspects, illustrative data may relate to: a geological parameter, a geophysical parameter, a petrophysical parameter, a wellbore parameter, a configuration of a wellbore tubular, a lithological parameter, and/or casing collars. The wellbore tool to be activated or controlled may include, but is not limited to, a perforating gun, a sensor, a formation evaluation tool, a production control device positioned in the wellbore, a seismic source, and/or a seismic receiver. Illustrative sensors include, but are not limited to, a formation evaluation tool, a casing collar locator, a pressure sensor, a temperature sensor, an NMR tool, a wellbore caliper, a directional survey tool, a fluid analysis tool, an accelerometer, and/or an odometer. In aspects, the method may include programming the processor to correlate the sensor measurements with a predetermined pattern associated with the data in the database, a preset value, and/or a preset range of values. In aspects, the method may include conveying a second sensor along the wellbore, and wherein the activating of the well tool does not occur unless a measurement from the second sensor meets preset criteria. The method of autonomous control may be employed for devices conveyed via a drill pipe, a coiled tubing, a slickline, or a free-fall device.

In aspects, the present disclosure provides an apparatus for autonomous control of a tool in a wellbore. An exemplary apparatus may include a well tool, a sensor associated with the well tool, a memory module programmed with data relating to a selected parameter of interest, and a processor in communication with the sensor and the memory module. The processor may be configured to activate the well tool if the processor determines that a measurement provided by the sensor correlates with the data in the database. In aspects, the present disclosure also provides a system for servicing a wellbore formed in an earthen formation. The system may include a rig, a conveyance device configured to convey the well tool into the wellbore, a well tool positioned along the conveyance device, a sensor positioned along the conveyance device, a memory module programmed with data relating to a selected parameter of interest, and a processor in communication with the sensor and the memory module. The processor may be programmed with: a predetermined pattern associated with the data in the database, a preset value, and/or a preset range of values. The processor may be programmed to activate the well tool when the processor finds: a substantial match between a predetermined pattern and at least one measured value, a preset value and at least one measured value, and/or a preset range of values and at least one measured range of values Examples of the more important features of the disclosure have been summarized (albeit rather broadly) in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE FIGURES

For detailed understanding of the present disclosure, reference should be made to the following detailed description of the preferred embodiment, taken in conjunction with the accompanying drawing.

DETAILED DESCRIPTION OF THE INVENTION

Figure 1:
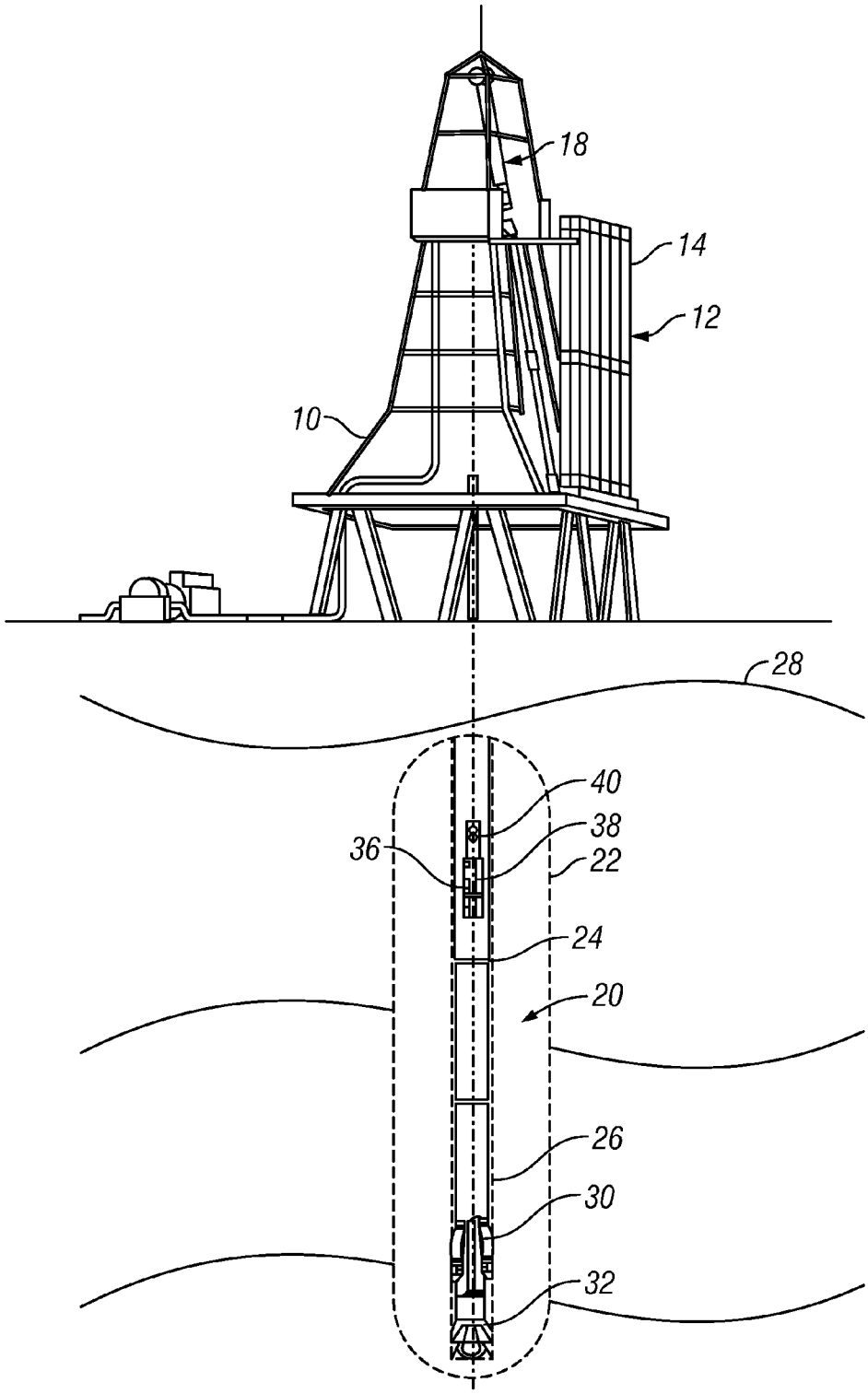
FIG. 1 schematically illustrates an elevation view of a drilling system utilizing autonomous downhole control in accordance with one embodiment of the present disclosure.

The present disclosure relates to devices and methods for autonomous control of tools used in a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown a conventional drilling tower 10 for performing one or more operations related to the construction, logging, completion or work-over of a hydrocarbon producing well. While a land well is shown, the tower or rig can be situated on a drill ship or another suitable surface workstation such as a floating platform or a semi-submersible for offshore wells. The tower 10 includes a stock 12 of tubular members generally referred to as drill string segments 14, which are typically of the same and predetermined length. The tubulars 14 can be formed partially or fully of drill pipe, metal or composite coiled tubing, liner, casing or other known members. Additionally, the tubulars 14 can include a one way or bidirectional communication link utilizing data and power transmission carriers such fluid conduits, fiber optics, and metal conductors. The tubulars 14 are taken from the rod stock 12 by means of a hoist or other handling device 18 and are joined together to become component parts of the drill string 20. In embodiments, the tubular 14 may be "stands." As is known, a stand may include a plurality of pipe joints (e.g., three joints). At the bottom of the drill string 20 is a bottomhole assembly (BHA) 22 illustrated diagrammatically in the broken-away part 24 that is adapted to form a wellbore 26 in the underground formation 28. The BHA includes a housing 30 and a drive motor (not shown) that rotates a drill bit 32.

The BHA 22 includes hardware and software to provide downhole "intelligence" that processes measured and preprogrammed data and writes the results to an on-board memory and/or transmits the results to the surface. In one embodiment, a processor 36 disposed in the housing 30 is operatively coupled to one or more downhole sensors (discussed below) that supply measurements for selected parameters of interest including BHA or drill string 20 orientation, formation parameters, and borehole parameters. The BHA can utilize a downhole power source such as a battery (not shown) or power transmitted from the surface via suitable conductors. In aspects, the present disclosure provides devices and methods for controlling tools and equipment positioned along the drill string 20 and/or the BHA 22.

It should be understood that the BHA 22 is merely representative of wellbore tooling and equipment that may utilize the teachings of the present disclosure. That is, the devices and methods for autonomous control of the present disclosure may also be used with other equipment, such as survey tools, completion equipment, etc.

Figure 2:
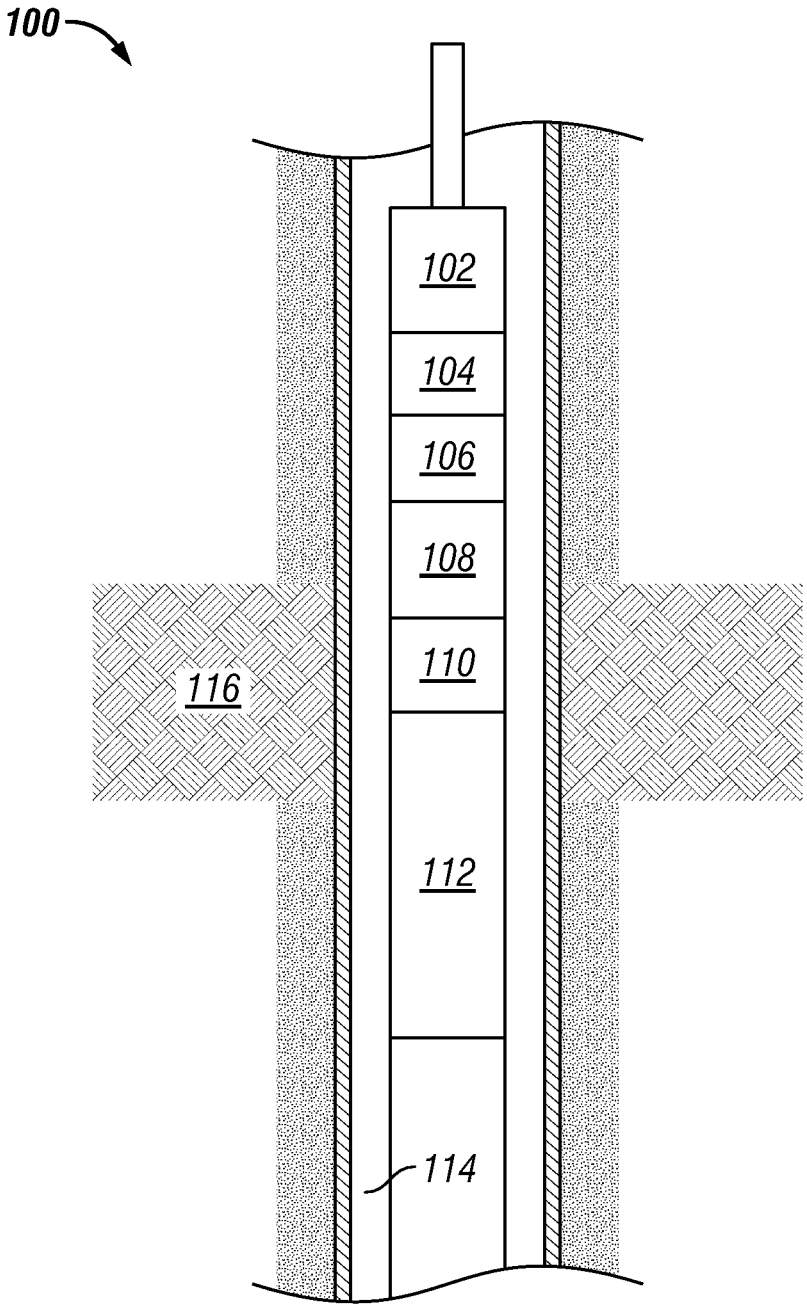
FIG. 2 functionally illustrates a control device made in accordance with one embodiment of the present disclosure.

Referring now to FIG. 2, there is shown an embodiment of a tool control device 100 that utilizes autonomous control in accordance with the present disclosure. In one arrangement, the tool control device 100 may include a processor 102, a memory 104 accessible by the processor 102, and a sensor 106. The wellbore tool control device 100 may also include a power source such as battery pack 108, a clock 110, and other suitable devices for supporting operation of the processor 102 and the sensor 106. The tool control device 100 may be configured to operate or activate a wellbore device 112, which may be any wellbore tool that is configured to perform any number of wellbore tasks. The memory 104 may be configured to store data written to the memory 104 at the surface, or "pre-loaded" data. As will be described in greater detail below, the processor 102 may be programmed with instructions to activate or deactivate the wellbore tool 112 upon determining that a measurement or measurements provided by the sensor 106 correlates in a prescribed manner with the data in the memory 108. The "preloaded" data may relate to any detectable naturally-occurring or man-made feature, object, or condition that is present in the wellbore 114 or the adjacent formation 116. In one configuration, the processor 102 is programmed to correlate measurements of the sensor 106 with a preset activation threshold value within the data in the memory 104. The preset activation threshold value may be a value, range of values, or pattern or sequence of values. In one aspect, for example, a correlation may include a substantial numerical match between a measured value and preloaded value for a given parameter.

In embodiments, the preloaded data type and values are selected, compiled and ordered in a manner that characterizes a specific location, feature, or depth along the wellbore 114. The data may relate to a geological parameter, a geophysical parameter, a petrophysical parameter, and/or a lithological parameter such as porosity, resistivity, gamma ray, and density for a formation intersected by the wellbore 114. The data may also relate to a wellbore parameter such as azimuth, inclination, and/or wellbore diameter that describes a trajectory or dimensions of the wellbore 114. Other suitable data may relate to a configuration of a wellbore tubular such as a liner or casing installed in the wellbore 114 or the number and/or depth location of casing collars in the wellbore 114.

The sensor 106 provides measurements that enable the processor 102 to determine whether the tool control device 100 is adjacent to or near a specific location, feature, or depth along the wellbore 114. For example, the sensor 106, which may include two or more sensors, may be configured to directly or indirectly detect or measure one more parameters discussed above that relate to the wellbore 114 or the formation 116. Exemplary sensors include, but are not limited to, formation evaluation tools, radiation detectors, gamma ray detectors, casing collar locators, pressure sensors, temperature sensors, NMR tools, wellbore calipers, directional survey tools, fluid analysis tools, accelerometer, odometers, magnetometers, gyroscopes, etc. It should be understood that the sensor 106 may include a suite of sensors and the database may include data for two or more different types of parameters.

Figure 3:
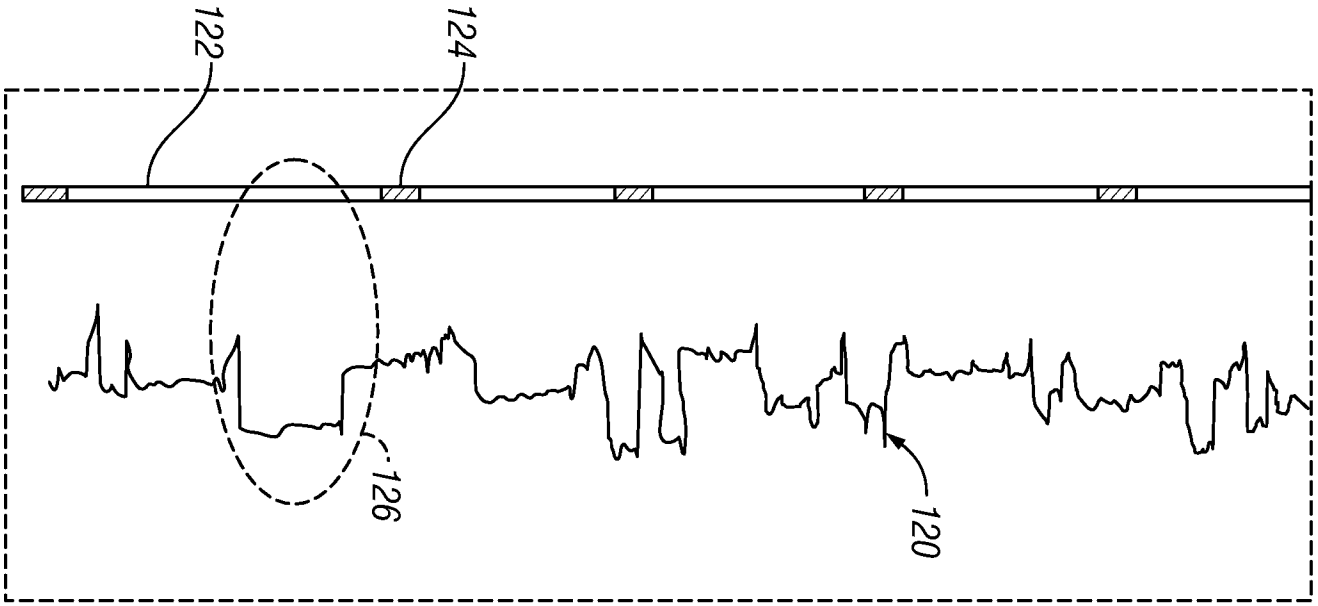
FIG. 3 is illustrative chart of measurements of a selected parameter of interest that may be represented by data in a database accessed by a control device made in accordance with one embodiment of the present disclosure.

Referring now to FIG. 3, there is shown an illustrative criteria that may be utilized by the processor 102 for correlating measurements from the sensor 106 with the data in the memory 104. FIG. 3 depicts an illustrative gamma ray plot 120 along a section of a wellbore. Also shown is a casing 122 and casing collars 124. In one arrangement, the plot 120 or a selected portion of the plot 120 is digitized and preloaded in the memory 104 (FIG. 2). In such an arrangement, the processor 102 (FIG. 2) may be programmed to monitor the output of the sensor 106 (FIG. 2), which may be a gamma ray detector, for gamma ray measurements that are the same or similar to the gamma ray value or values at the region labeled 126. The preloaded value or values may be expressed as a maxima and/or a minima, a sequence of maxima and/or minima or any other pattern of values or data order that uniquely identifies that particular depth or location in the wellbore. In another arrangement, the processor 102 (FIG. 2) may be programmed to monitor the output of the sensor 106 (FIG. 2) to detect and count the number casing collars 124 until a preset number of casing collars 124 have been reached. Once the processor 102 detects the preset value, values or pattern within the sensor measurements, the processor 102 may initiate one or more preset actions.

The nature or types of actions that may be autonomously initiated by the processor 102 depend in part on the tooling that is conveyed into the wellbore or is already present in the wellbore. Depending on the tooling, the processor 104 may issue a signal that instructs the tool to energize or de-energize, to move between power states (e.g., sleep to full power), to start or stop operation for a specified period, or switch between operating modes (e.g., "measure only" to "measure and record to memory"). For instance, the processor 104 may be programmed to fire a perforating gun, initiate the inflation of a packer, release an additive, or activate a well stimulation tool. In other arrangements, the processor 104 may operate devices that may be used to investigate the formation 116 such as formation evaluation tools, seismic sources, or seismic receivers. In still other embodiments, the processor 104 may operate production control devices; e.g., valves that may be shifted between open and closed positions. The processor 104 may transmit the signals to the tool or tools via wire (e.g., electrical or optical) or wirelessly. It should be understood that the signals need not be transmitted directly to the tool. Rather, the processor 104 may control a power source or supply that energizes the tool.

In embodiments, the processor 102 may be programmed to monitor multiple parameters in conjunction with the activation of the tool 112. For instance, after the processor 102 determines that the sensor measurements correlate in a desired manner with the preloaded data, the processor 102 may determine whether one or more separate parameter set points or thresholds are satisfied (e.g., pressure, temperature, expiration of a time delay period, wellbore fluid chemistry, etc.). If so, the processor 102 may proceed with activation of the tool 112. If not, the processor 102 may be programmed to wait until the parameter set points or thresholds are satisfied, abort the activation sequence, or take some other preprogrammed steps.

It should be appreciated that the tool control device 100 may provide self-directed and intelligent control of wellbore equipment, which may reduce or eliminate the need for human intervention in the operation of such wellbore equipment. Thus, the tool control device 100 may be employed on conveyance devices that have either limited or no data and/or power transfer from the surface. Thus, the conveyance device 110 may be a drill pipe, a coiled tubing, or a slickline. In embodiments, the tool control device 100 may also be configured as a free-fall device that is dropped into a well.

In certain embodiments, the memory 108 may be programmed with data that is preloaded at the surface. Thus, the processor 102 may access the memory 104 as needed during deployment. In embodiments, the processor 102 may be configured to write data to the memory 104 while downhole. That is, the data in the memory 104 may be dynamically updated. For example, the processor 102 may maintain a historical record of the number of casing collars that have been detected while being tripped downhole and utilize that information while being tripped out of the wellbore. In another example, one or more formation evaluation tools may detect a transition into a shale layer or a sand layer. The processor 102 may maintain a historical record of the different layers and formations that have been traversed for later use.

In one exemplary mode of operation, the tool control device 100 may be utilized to fire a perforating gun at a specified depth in the wellbore. At the surface, a pre-existing well log is used to identify certain parameters that may be used to uniquely characterize the region to be perforated. The parameter, for example, may be a gamma ray log and a particular sequence of previously logged values for gamma ray emissions may uniquely characterize that region. Thus, the memory 104 may be preloaded with that sequence of previously logged gamma ray values and the processor 102 may be programmed to fire a perforating gun once the sensor 106 measures gamma ray emissions that, within a specified tolerance, match the preloaded values. The processor 102 may also be programmed with a minimum temperature and/or pressure that should also exist in order to fire the perforating gun. Thereafter, the tool control device 100 along with the perforating gun (shown generically as tool 112) is conveyed into the wellbore 114. In either the trip into the wellbore 114 or the trip out of the wellbore 114, the processor 102 continually monitors the output of the sensor 106. Once the output of the sensor 106 indicates that the gamma ray emissions match that of the preloaded sequence and the processor 102 confirms that the pressure and temperature values are within prescribed ranges, the processor 102 sends a signal that fires the perforating gun. It should be appreciated that this wellbore operation did not require a prior run to determine the measured depth for the region to be perforated and did not require the well operator to monitor measured depth as a necessary element in order to operate the perforating gun. Rather, as should be appreciated, the processor 102 has been supplied with sufficient intelligence to locate the region to be perforated and take the necessary actions to perforate that region. While the mode of operation has been discussed in the context of a formation perforation activity, it should be understood that the same techniques may be applied to any other activities that may be undertaken during the drilling, completion, logging, recompletion or workover of a well.

It should be understood that the teachings of the present disclosure are not limited to tooling conveyed by rigid carriers such as drill strings, such as that shown in FIG. 2. In embodiments, the above-described methods and devices may be employed on non-rigid carriers such as slick lines. In still other embodiments, the above-described methods and devices may be used in connection with drop survey devices that are released into the wellbore.

While the foregoing disclosure is directed to the preferred embodiments of the invention, various modifications will be apparent to those skilled in the art. It is intended that all variations within the scope of the appended claims be embraced by the foregoing disclosure.

What is claimed is:

1. A method for activating a tool at a selected location in a wellbore drilled in a subterranean formation, comprising:

measuring a parameter of interest using a formation evaluation tool that investigates the formation surrounding the wellbore, wherein the measured parameter of interest characterizes the selected location in the drilled wellbore;

programming a memory module of a processor with a database having pre-existing data relating to the parameter of interest;

conveying a sensor and the processor to the selected location along the drilled wellbore, the sensor configured to measure a parameter of interest relating to the pre-existing data by investigating the formation surrounding the wellbore;

monitoring a measurement output of the sensor using the processor in the wellbore while the sensor is being conveyed along the wellbore;

determining whether the location in the drilled wellbore has been reached by using the processor in the wellbore to correlate the measurement output of the sensor with the pre-existing data in the database; and transmitting a signal to a wellbore tool using the processor in the wellbore if the processor determines that the location has been reached.

2. The method of claim 1 wherein the pre-existing data identifies a location in the wellbore and relates to: (i) a geological parameter, (ii) a geophysical parameter, (iii) a petrophysical parameter, and (iv) a lithological parameter.

3. The method of claim 1, wherein the wellbore tool is one of: (i) a perforating gun, (ii) a sensor, (iii) a formation evaluation tool, (iv) a production control device positioned in the wellbore, (v) a seismic source, (vi) a seismic receiver.

4. The method of claim 1, wherein the sensor is one of: (i) a formation evaluation tool, (ii) a pressure sensor, (iii) a temperature sensor, (iv) an NMR tool, and (v) a fluid analysis tool.

5. The method of claim 1 further comprising programming the processor to correlate the sensor measurement including at least one numerical value that corresponds with one of:

(i) a predetermined pattern associated with the data in the database; (ii) a preset value, and (iii) a preset range of values.

6. The method of claim 1, further comprising conveying a second sensor along the wellbore, and wherein the transmitting does not occur unless a measurement from the second sensor meets a preset criteria.

7. The method of claim 1, wherein the sensor and the processor are conveyed via one of: (i) a drill pipe, (ii) a coiled tubing, (iii) a slickline, and (iv) a free-fall device.

8. The method of claim 1, wherein measuring a parameter of interest in the wellbore using a formation evaluation tool that investigates the formation includes logging the formation surrounding the wellbore to obtain the pre-existing data; and further comprising:

correlating the pre-existing data and the sensor measurements to identify a characteristic along the wellbore selected from one of: (i) a specific location, (ii) feature, or (iii) depth.

9. The method of claim 1, wherein the sensor is a formation evaluation tool that investigates the formation surrounding the wellbore.

10. An apparatus for controlling a downhole tool in a wellbore, comprising:

a well tool configured to be conveyed along the wellbore;

a memory module positioned along the well tool and programmed with pre-existing data for a first parameter of interest obtained by investigating a formation surrounding the wellbore with a formation evaluation tool;

a sensor associated with the well tool and configured to measure a second parameter of interest relating to the formation surrounding the wellbore by investigating the formation surrounding the wellbore; and a processor conveyed along the wellbore and in communication with the sensor and the memory module, the processor configured to monitor a measurement output of the sensor while the sensor is being conveyed along the wellbore and to transmit a signal to the well tool when the location has been reached, the processor determining the location by correlating a measurement provided by the sensor with the pre-existing data in the database.

11. The apparatus of claim 10 further comprising a conveyance device configured to convey the well tool into the wellbore.

12. The apparatus of claim 11, wherein the conveyance device is one of: (i) a drill pipe, (ii) a coiled tubing, (iii) a slickline, and (iv) a free-fall device.

13. The apparatus of claim 10 wherein the data relates to: (i) a geological parameter, (ii) a geophysical parameter, (iii) a petrophysical parameter, and (iv) a lithological parameter.

14. The apparatus of claim 10, wherein the wellbore tool is one of: (i) a perforating gun, (ii) a sensor, (iii) a formation evaluation tool, (iv) a production control device positioned in the wellbore, (v) a seismic source, (vi) a seismic receiver.

15. The apparatus of claim 10, wherein the sensor is one of:

(i) a formation evaluation tool, (ii) a pressure sensor, (iii) a temperature sensor, (iv) an NMR tool, and (v) a fluid analysis tool.

16. The apparatus of claim 10, wherein the processor is programmed to correlate the sensor measurement including at least one numerical value that corresponds with one of: (i) a predetermined pattern associated with the data in the database; (ii) a preset value, and (iii) a preset range of values.

17. The apparatus of claim 10, further comprising conveying a second sensor along the wellbore, and wherein the transmitting does not occur unless a measurement from the second sensor meets a preset criteria.

18. The apparatus of claim 10, wherein the first parameter of interest relating to a formation surrounding the wellbore and the second parameter of interest relating to a formation surrounding the wellbore are the same parameters.

19. A system for servicing a wellbore formed in an earthen formation, comprising:

a rig;

a conveyance device configured to convey a well tool along the wellbore;

a memory module programmed with pre-existing data relating to a selected parameter of interest previously measured in the wellbore by investigating the formation surrounding the wellbore with a formation evaluation tool;

a sensor positioned along the conveyance device and configured to measure a parameter of interest relating to the pre-existing data by investigating the formation surrounding the wellbore with a formation evaluation tool; and a processor in communication with the sensor and the memory module and positioned along the conveyance device, the processor configured to monitor a measurement output of the sensor while the sensor is being conveyed along the wellbore and to transmit a signal to the well tool when the location has been reached, the processor determining the location by correlating a measurement provided by the sensor with the pre-existing data in the database.

20. The system of claim 19, wherein the conveyance device is one of: (i) a drill pipe, (ii) a coiled tubing, (iii) a slickline, and (iv) a free-fall device.

21. The system of claim 19 wherein the data relates to: (i) a geological parameter, (ii) a geophysical parameter, (iii) a petrophysical parameter, and (iv) a lithological parameter.

22. The system of claim 19, wherein the processor is programmed with one of: (i) a predetermined pattern associated with the data in the database; (ii) a preset value, and (iii) a preset range of values.

23. The system of claim 22, wherein correlation is a substantial match between one of:

(i) a predetermined pattern and at least one measured value; (ii) a preset value and at least one measured value, and (iii) a preset range of values and at least one measured range of values.

* * * * *